US009410762B2

(12) United States Patent
Ballard

(10) Patent No.: US 9,410,762 B2
(45) Date of Patent: Aug. 9, 2016

(54) FIREARM STOCK WITH FOLDING BIPOD

(71) Applicant: Michael W. Ballard, Cerritos, CA (US)

(72) Inventor: Michael W. Ballard, Cerritos, CA (US)

(73) Assignee: PRO MAG MFG., INC., Phoenix, AZ (US)

( * ) Notice: Subject to any disclaimer, the term of this patent is extended or adjusted under 35 U.S.C. 154(b) by 172 days.

(21) Appl. No.: 13/736,691

(22) Filed: Jan. 8, 2013

(65) Prior Publication Data

US 2014/0190059 A1 Jul. 10, 2014

(51) Int. Cl.
*F41C 23/08* (2006.01)
*F41A 23/08* (2006.01)
*F41C 23/16* (2006.01)

(52) U.S. Cl.
CPC ..... *F41A 23/08* (2013.01); *F41C 23/16* (2013.01)

(58) Field of Classification Search
CPC ..... F41A 23/02; F41A 23/08; F41A 23/10
USPC ..... 42/94
See application file for complete search history.

(56) References Cited

U.S. PATENT DOCUMENTS

| | | | | | |
|---|---|---|---|---|---|
| 2,436,349 | A * | 2/1948 | Adams | ..... | 42/94 |
| 2,807,904 | A * | 10/1957 | Kreske | ..... | 42/94 |
| 4,776,124 | A * | 10/1988 | Clifton | ..... | 42/94 |
| 5,029,407 | A * | 7/1991 | Kirkpatrick | ..... | 42/94 |
| 6,289,622 | B1 * | 9/2001 | Desch et al. | ..... | 42/94 |

* cited by examiner

*Primary Examiner* — Stephen M Johnson
*Assistant Examiner* — Benjamin Gomberg
(74) *Attorney, Agent, or Firm* — Bennet K. Langlotz; Langlotz Patent & Trademark Works, Inc.

(57) ABSTRACT

The firearm stock has a body including a forend. The bottom of the forend has an elongate slot. A bipod having a plurality of legs is pivotally attached at one end of the legs to the bottom of the forend. The bipod has an unfolded position in which an opposing end of the legs extends downwards beyond the exterior contour of the forend. The bipod has a folded position in which the opposing end of the legs is received within the elongate slot with the legs substantially within the exterior contour of the forend. The opposing end of the legs may each have a notch. There may be a latch having a cam surface that is spring biased to protrude into the slot. The notches may receive the cam surface when the bipod is in the folded position, thereby releasably securing the opposing end of the legs within the slot.

19 Claims, 10 Drawing Sheets

FIREARM STOCK WITH FOLDING BIPOD

FIELD OF THE INVENTION

The present invention relates to firearms, and more particularly to a firearm stock having a bipod that folds flush into the stock when not in use.

BACKGROUND OF THE INVENTION

A bipod is a two-legged attachment for a firearm that provides stability along two axes of motion (side-to-side and up-and-down). Bipods are commonly used on rifles and machine guns to provide a forward rest and reduce motion. They are also found on other long-barreled weapons. Bipods permit users to easily rest a firearm on objects, like the ground or a wall, to reduce their fatigue and increase the firearm's accuracy and stability. Bipods can be of fixed or adjustable length. Some can be tilted and also have their tilting point close to the barrel's central axis, allowing the firearm to tilt left and right. There are three ways for bipods to be folded: away from the shooter, towards the shooter, or into a vertical foregrip.

A variety of prior art folding bipods attached to firearms stocks are known. However, these continue to protrude from the firearm stock even in the folded position. This makes the firearm more vulnerable to being snagged on plant life, articles of clothing, or other obstacles. The folded bipod also prevents a comfortable grip on the forend.

Therefore, a need exists for a new and improved firearm stock with folding bipod that allows the user to fold the bipod flush into the firearm's stock when not in use. In this regard, the various embodiments of the present invention substantially fulfill at least some of these needs. In this respect, the firearm stock with folding bipod according to the present invention substantially departs from the conventional concepts and designs of the prior art, and in doing so provides an apparatus primarily developed for the purpose of allowing the bipod to fold flush into the firearm's stock when not in use.

SUMMARY OF THE INVENTION

The present invention provides an improved firearm stock with folding bipod, and overcomes the above-mentioned disadvantages and drawbacks of the prior art. As such, the general purpose of the present invention, which will be described subsequently in greater detail, is to provide an improved firearm stock with folding bipod that has all the advantages of the prior art mentioned above.

To attain this, the preferred embodiment of the present invention essentially comprises a body including a forend. The bottom of the forend has an elongate slot. A bipod having a plurality of legs is pivotally attached at one end of the legs to the bottom of the forend. The bipod has an unfolded position in which an opposing end of the legs extends downwards beyond the exterior contour of the forend. The bipod has a folded position in which the opposing end of the legs is received within the elongate slot with the legs substantially within the exterior contour of the forend. The opposing end of the legs may each have a notch. There may be a latch having a cam surface that is spring biased to protrude into the slot. The notches may receive the cam surface when the bipod is in the folded position, thereby releasably securing the opposing end of the legs within the slot. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
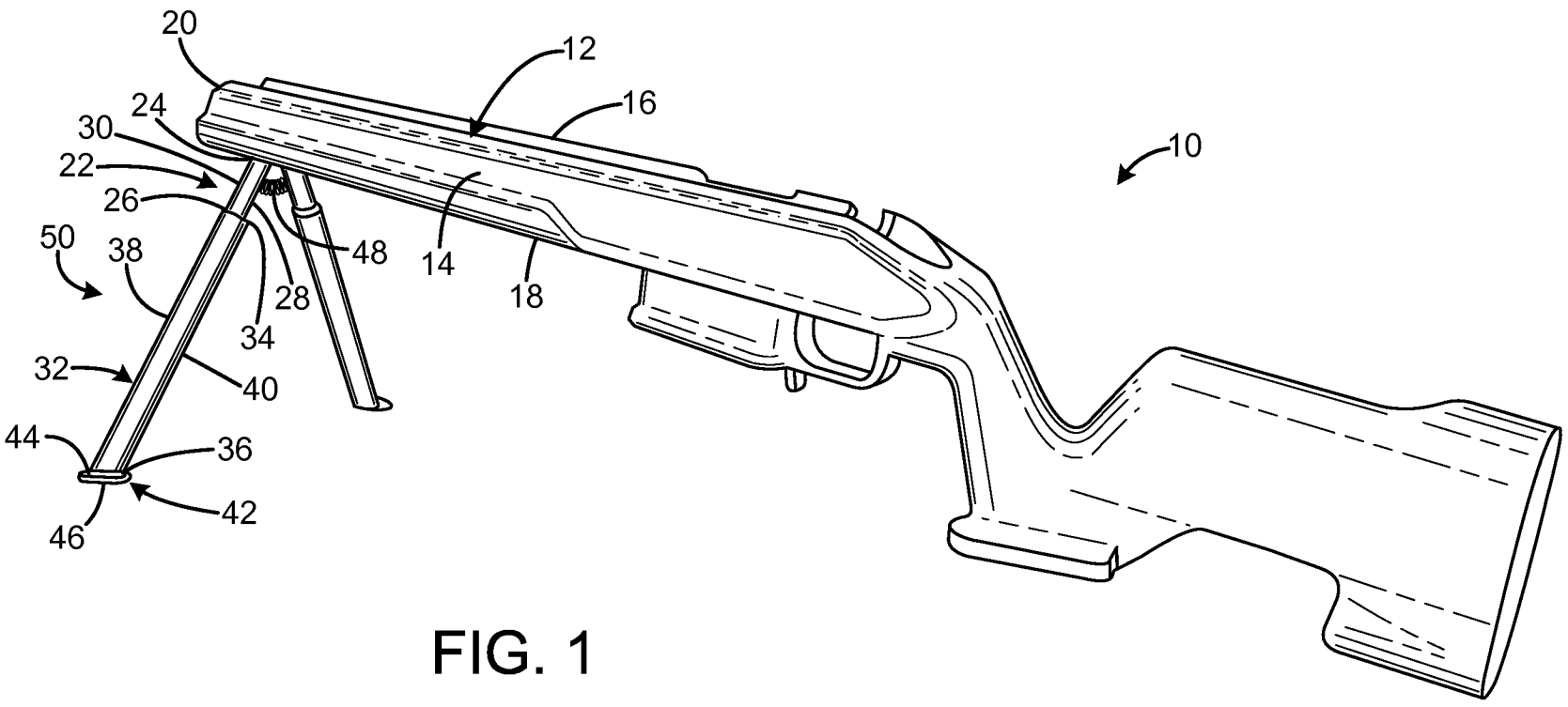
FIG. 1 is a rear isometric view of the current embodiment of the firearm stock with folding bipod constructed in accordance with the principles of the present invention with the bipod in the unfolded position.

An embodiment of the firearm stock with folding bipod of the present invention is shown and generally designated by the reference numeral 10.

Figure 2:
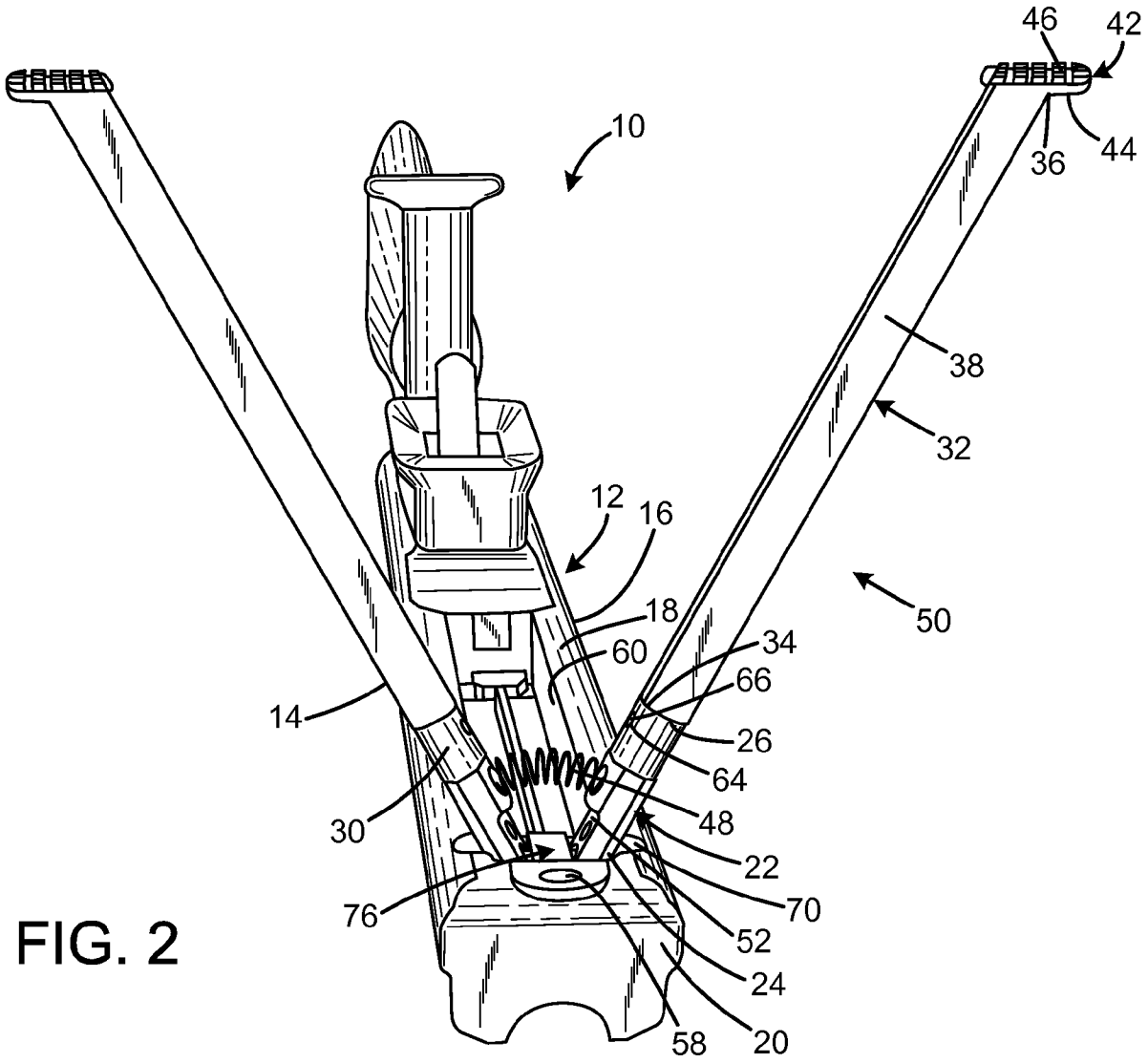
FIG. 2 is a bottom front view of the current embodiment of the firearm stock with folding bipod of FIG. 1 with the bipod in the unfolded position.

FIGS. 1 and 2 illustrate the improved firearm stock with folding bipod 10 of the present invention. More particularly, the firearm stock is an elongate element having a left side 14, right side 16, bottom 18, and front 20. The front of the stock forms a forend 12. A folding bipod 50 extends downward from the bottom front of the forend when the bipod is in the unfolded position. In the current embodiment, the stock is made of plastic to reduce weight while still providing adequate strength to support a barrel, trigger group, and any additional accessories to form a complete firearm.

The bipod 50 has two leg bases 22 and two leg extensions 32 that are mirror images of one another, with one leg base and leg extension extending downwards to the right and one extending downwards to the left. The bottommost portion of the bipod is two outwardly protruding pads 42 formed by the bottoms 36 of the leg extensions. The pads are angled so that they are parallel to the bottom of the forend when the bipod is in the unfolded position. In the current embodiment, the bottom surfaces 46 of the pads have a traction surface pattern to prevent slippage of the leg extensions when the bipod is in use. The top surfaces 44 of the pads are connected to the bottoms 36 of the leg extensions, and are integral to the leg extensions in the current embodiment. The leg extensions 32 are elongate elements having fronts 38, rears 40, and tops 34. The bottom front of the forend has an aperture 58. In the current embodiment, the pads and leg extensions are made of plastic to reduce weight while still providing adequate strength to support the front of a fully assembled firearm that utilizes the firearm stock 10 of current invention. In the current embodiment, the leg bases are made of aluminum for additional strength.

Figure 3:
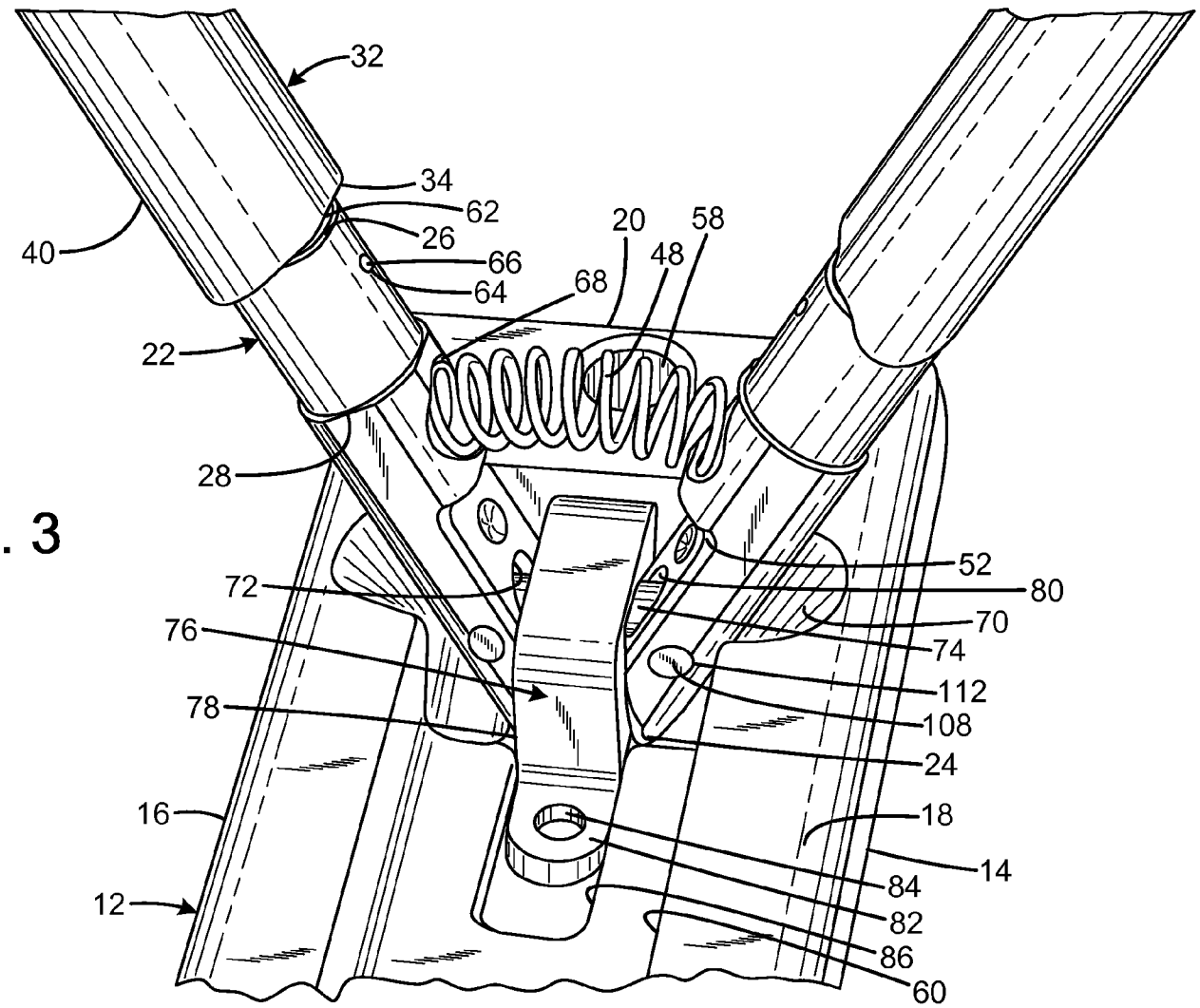
FIG. 3 is an enlarged bottom rear partial view of the current embodiment of the firearm stock with folding bipod of FIG. 1 with the bipod in the unfolded position.

FIG. 3 illustrates the improved firearm stock with folding bipod 10 of the present invention. More particularly, the bottom front 20 of the forend 12 and the top portions of the bipod 50 have been enlarged so that their features may be better appreciated. The tops 34 of the leg extensions 32 are received within bores 62 within the bottoms 26 of the leg bases 22. The tops of the leg extensions are secured within the bores by pins 66 inserted through apertures 64 in the leg bases and through apertures (not visible) in the tops of the leg extensions.

Each leg base 22 has an aperture 68 above the aperture 64. The apertures 68 receive the opposed ends (not visible) of a coil spring 48. The spring 48 biases the leg bases outwards so that the tops 24 of the leg bases are pushed into the leg base slots 70. As a result, the bipod forms a V-shape when in the unfolded position.

Each leg base 22 has a rectangular recess 52 located above the aperture 68. Each recess has a bore 72 that receives one of the opposed ends of an axle 74. The axle is received within, a central bore 80 of a block 76. Additional details of these features will be discussed subsequently in the description of FIGS. 4 and 5.

Figure 4:
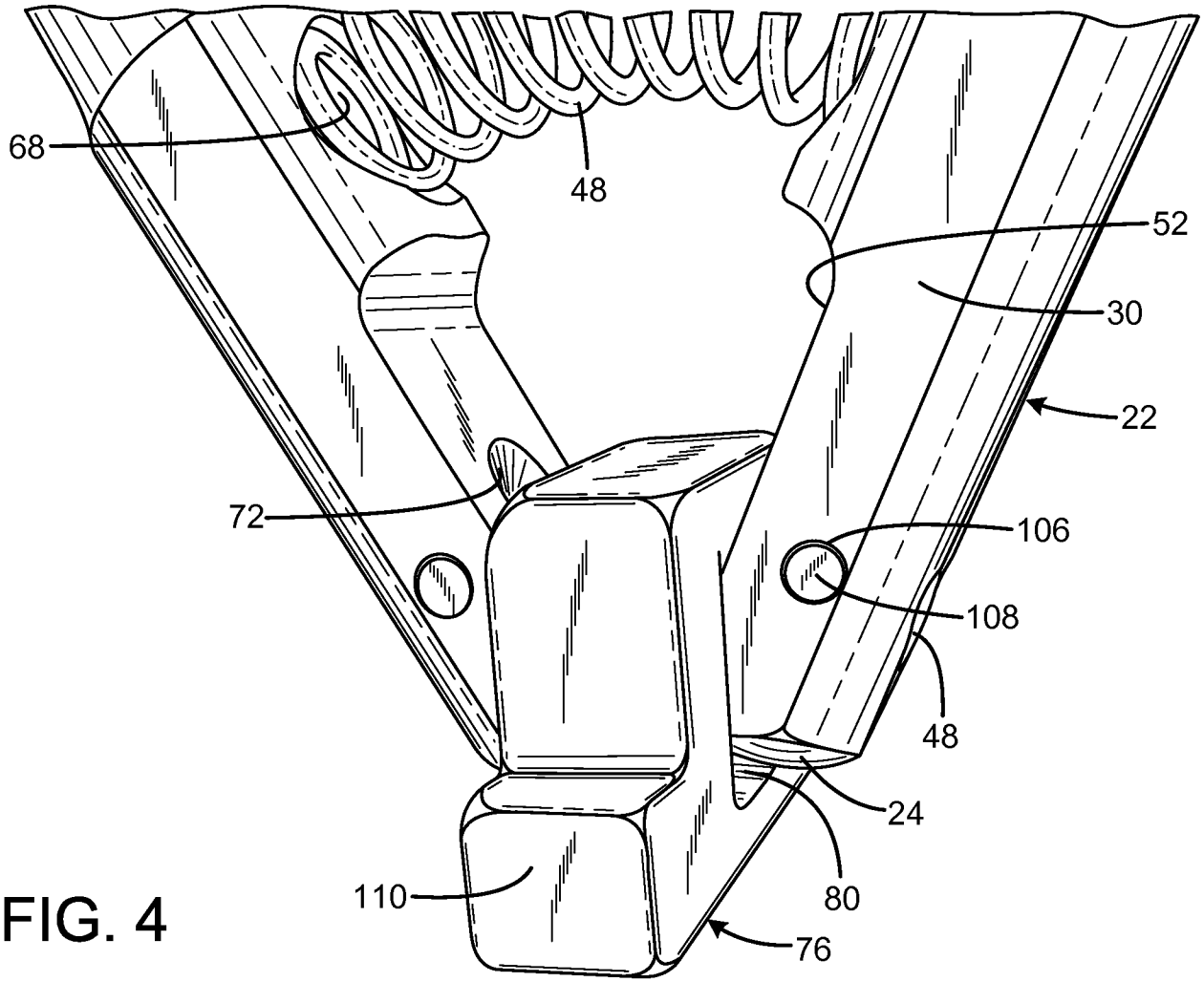
FIG. 4 is an enlarged front isometric partial view of the current embodiment of the folding bipod removed from the firearm stock with folding bipod of FIG. 1 with the bipod in the unfolded position.
Figure 5:
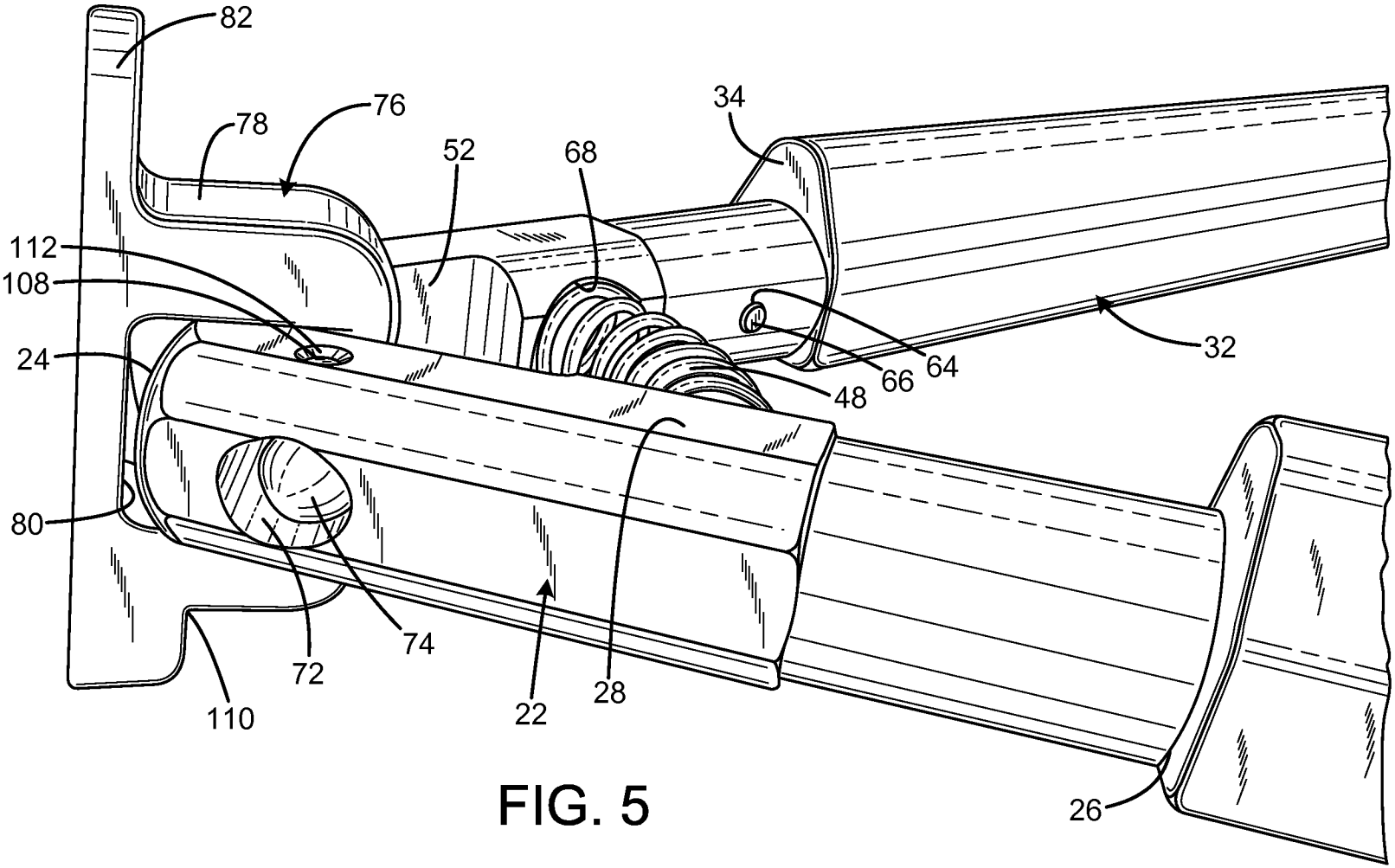
FIG. 5 is an enlarged left side partial view of the current embodiment of the folding bipod of FIG. 4 with the bipod in the unfolded position.

FIGS. 4 and 5 illustrate the improved folding bipod 50 of the present invention. More particularly, the bipod is depicted removed from the forend 12, and the block 76 and leg bases 22 have been enlarged so that their features may be better appreciated. The bores 72 located in the rectangular recesses 52 of the leg bases 22 are bored at an angle to permit the spring 48 to outwardly bias the leg bases and pivot the leg bases about the opposing ends of the axle 74. The leg bases 22 each have a bore 106 in their fronts 30 that receives a pin 108 that pins the leg bases to the axle (visible m FIG. 10). The block 76 has a front 110 and a rear 78. A rear flange 82 extends rearward from the block 76 and has an aperture 84 (visible in FIG. 5) that enables the attachment of the bipod to the forend.

Figure 6:
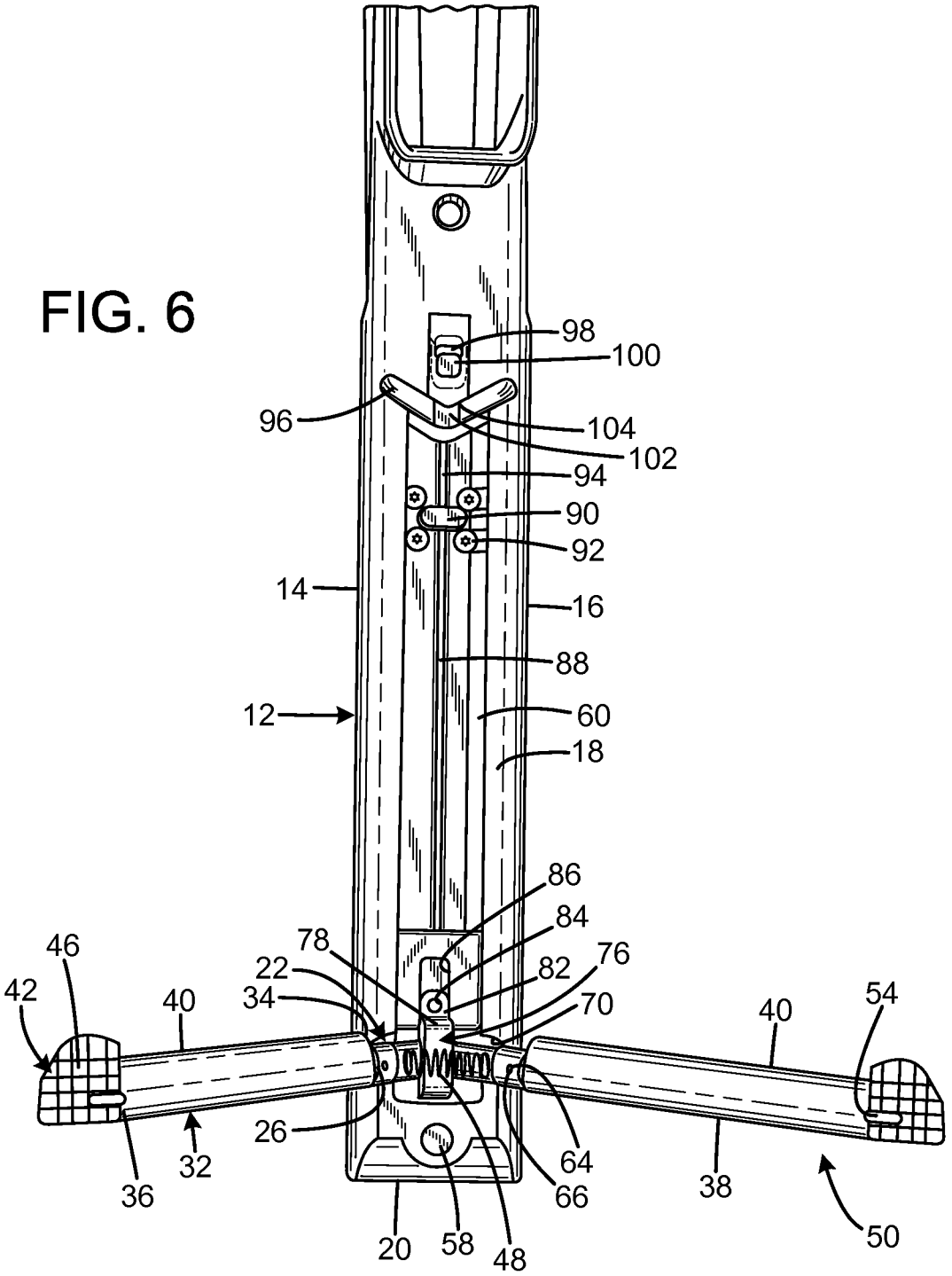
FIG. 6 is a bottom partial view of the current embodiment of the firearm stock with folding bipod of FIG. 1 with the bipod in the unfolded position.

FIG. 6 illustrates the improved forend 12 and folding bipod 50 of the present invention. More particularly, the bottom 18 of the forend and the bottom surfaces 46 of the pads 42 are clearly visible. Each pad has a latch slot 54 that receives the cam surface latch 102 when the bipod is in the folded position. The bottom front of the forend has a flange slot 86 that receives the block 76. The front of the block is received inside of the front 20 of the forend, and the aperture 84 is aligned with a threaded aperture (not visible) within the flange slot that receives a bolt (not shown) to secure the block to the forend.

The bottom 18 of the forend 12 has a slot 60 located behind and encompassing the flange slot 86. The slot 60 has a divider 88 and a rear divider 94 that divide the slot into two mirror image elongate channels that are shaped to closely receive the rears 40 of the leg extensions 32. The rear most portion of the slot 60 terminates in two mirror image pad slots 96 that are shaped to closely receive the pads 42.

Four screws 92 secure a lift assister 90 between the divider 88 and the rear divider 94. The lift assister is an oblong spring-loaded button that is compressed when the leg extensions 32 are pressed into the slot 60. The spring within the lift assister remains compressed because the latch 102 protruding from an aperture 104 located between the pad slots 96 is received within the latch slots 54 in the pads 42. As long as the latch is engaged with the latch slots, the lift assister cannot push the leg extensions downwards. The latch 102 is connected to a latch lever 100 that protrudes from a latch slot 98 located behind the aperture 104. A spring within the forend (not visible) biases the latch lever and latch forward. When the user slides the latch lever rearwards within the latch slot, the latch retracts from the latch slots into the aperture 104. Once the latch has cleared the latch slots, the spring within the lift assister decompresses and pushes the leg extensions downwards so the user can easily grab the leg extensions and pivot the bipod 50 into the unfolded position.

The leg bases 22 can pivot about the axle forward and rearward with their forward movement limited by the leg base slots 70, and their rearward movement limited by the depth of the slot 60. Their outward pivoting movement about the pins 108 is limited by a combination of the apertures 72 contacting the axle 74, the width of the leg base slots 70, and the contact of the tops 24 of the leg bases within the rectangular bore 80 in the block 76.

Figure 7:
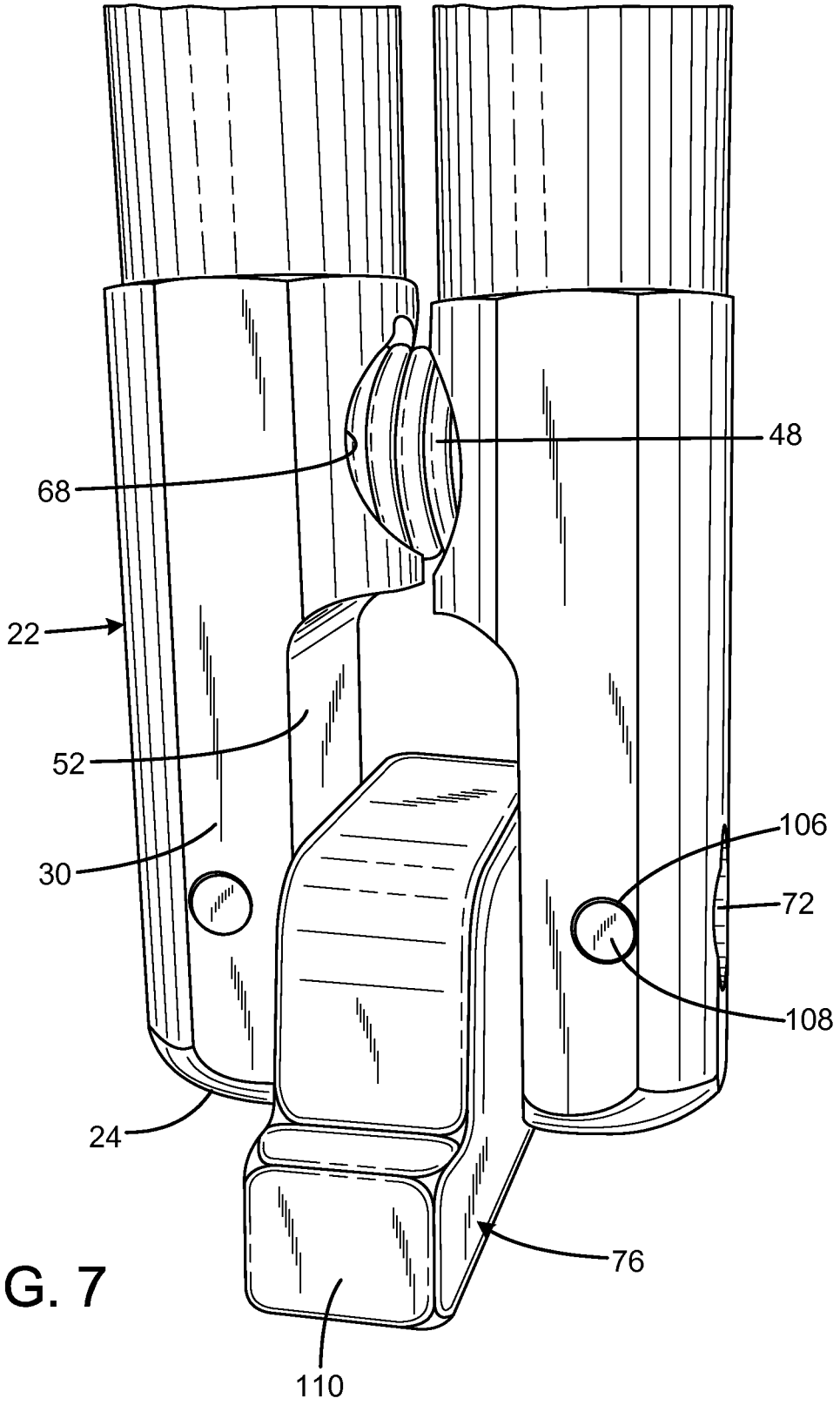
FIG. 7 is an enlarged bottom front isometric view of the current embodiment of the folding bipod of FIG. 4 with the bipod in the ready to fold position.
Figure 8:
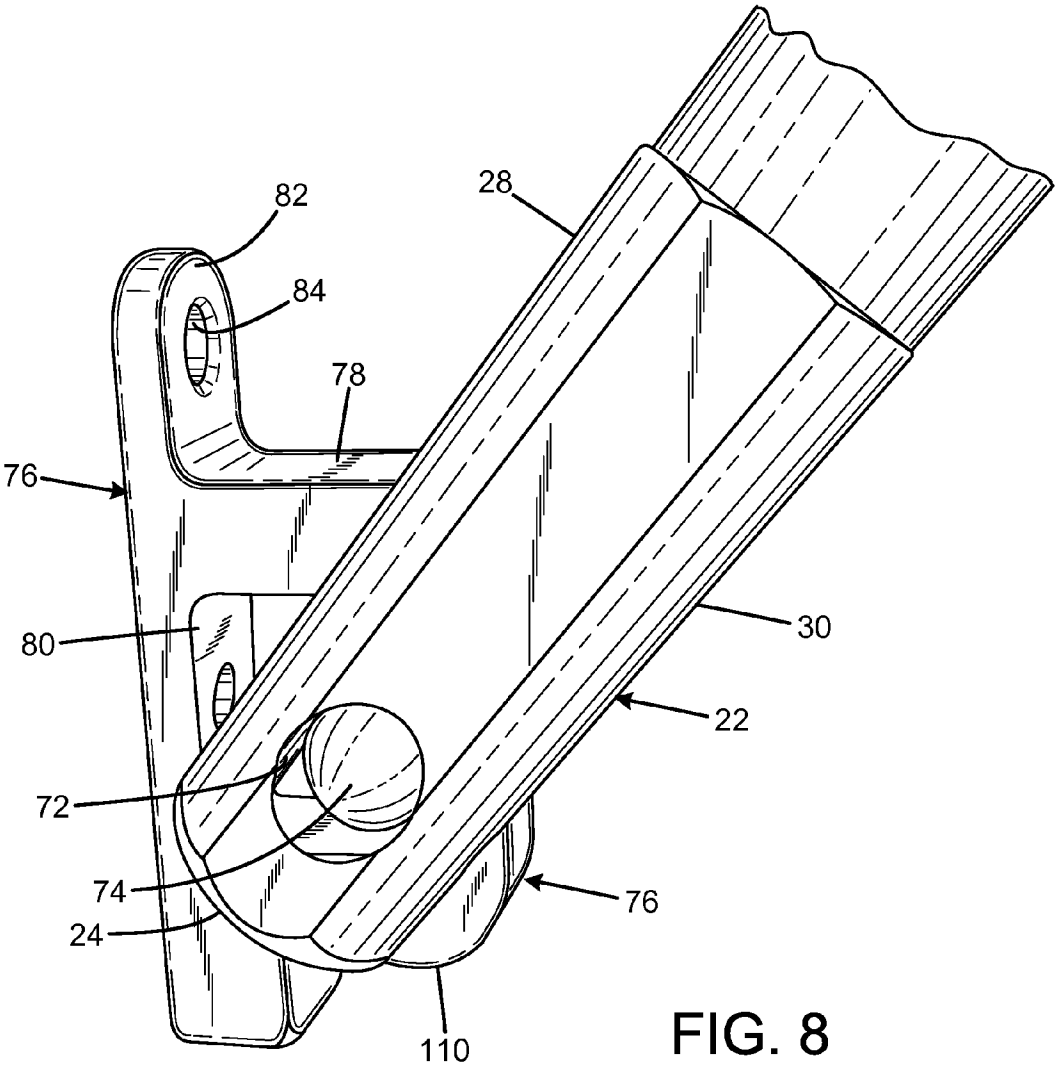
FIG. 8 is an enlarged left side partial view of the current embodiment of the folding bipod of FIG. 4 with the bipod in transition between the ready to fold position and the folded position.
Figure 9:
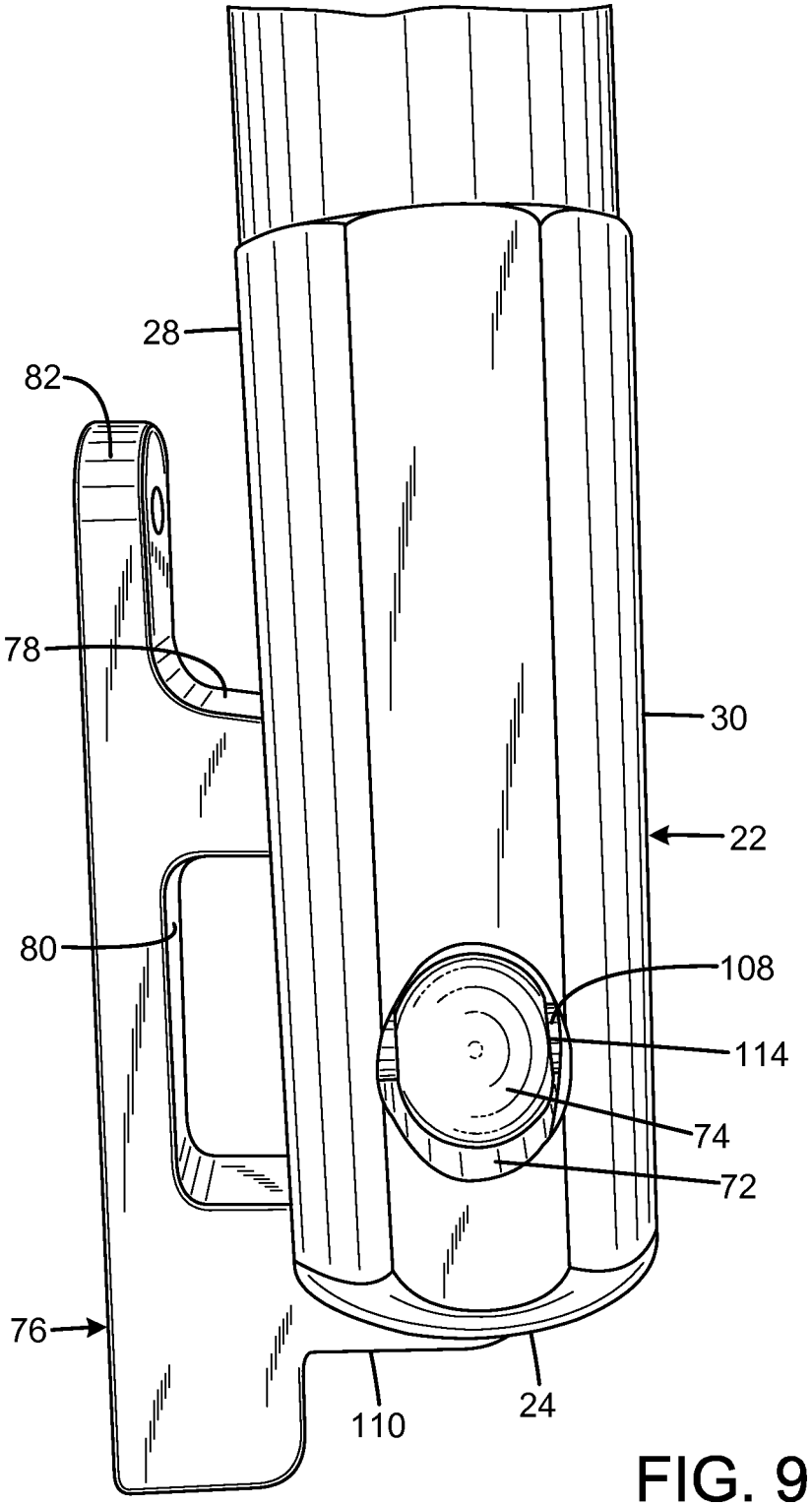
FIG. 9 is an enlarged left side partial view of the current embodiment of the folding bipod of FIG. 4 with the bipod in the folded position.

FIGS. 7-9 illustrate the improved folding bipod 50 of the present invention. More particularly, the bipod is depicted removed from the forend 12, and the block 76 and leg bases 22 have been enlarged so that their features may be better appreciated. FIG. 7 shows the position of the leg bases 22 when they are in the ready to fold position. The spring 48 is compressed into the apertures 68 in the leg bases. The leg bases have pivoted about the pins 108 so that the leg bases are substantially perpendicular to the axle 74 (not visible) and extend perpendicularly downward from the forend. The ability of the leg bases to assume this position on either side of the block 76 is because of the rectangular recesses 52.

FIG. 8 shows the position of the leg bases 22 when they are in the partially folded position. The leg bases are pivoted rearwards about the axle 74. The rectangular recesses 52 provide adequate clearance for the leg bases with respect to the block 76.

FIG. 9 shows the position of the leg bases 22 when they are in the folded position. The leg bases have pivoted rearwards about the axle 74 until they are parallel with the bottom 18 of the forend 12. One of the bores 114 in the opposing ends of the axle 74 that receive the pins 108 is visible through the aperture 72 in the right leg base.

Figure 10:
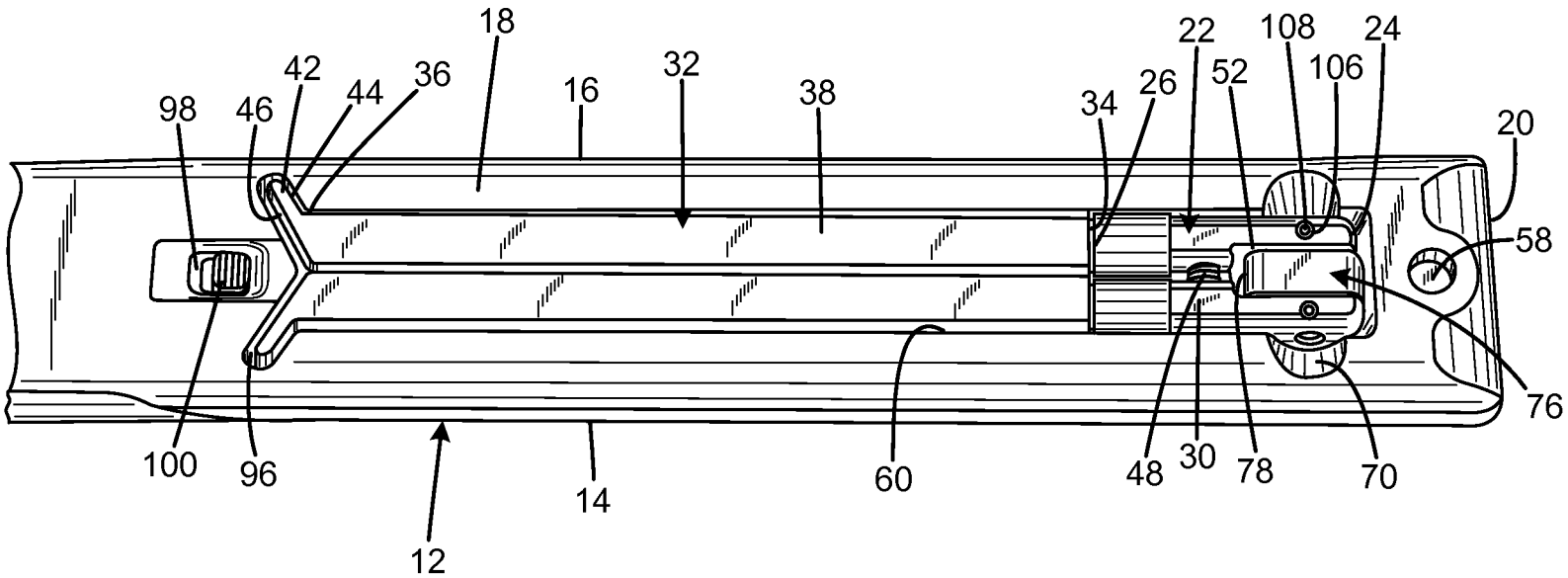
FIG. 10 is a bottom partial view of the current embodiment of the firearm stock with folding bipod of FIG. 1 with the bipod in the folded position.

FIG. 10 illustrates the improved forend 12 and folding bipod 50 of the present invention. More particularly, the bipod is depicted in the folded position. The rears 28 of the leg bases and rears 40 of the leg extensions 32 are closely received within the slot 60. The slot 60 and the flange slot 86 have sufficient depth at the necessary locations that the fronts 30 of the leg bases, the fronts 38 of the leg extensions, and the block 76 are flush with the bottom 18 of the forend. As a result, when the bipod is in the folded position, nothing protrudes from the exterior of the forend that makes a firearm employing the stock 10 more vulnerable to becoming snagged than a firearm omitting a folding bipod.

In the context of the specification, the terms "down" and "downward," "up" and "upward," "rear" and "rearward," and "front" and "forward" have the following definitions: "down" or "downward" means in the direction away from the bottom of the firearm, "up" and "upward" means in the direction toward the bottom of the firearm, "rear" or "rearward" means in the direction away from the muzzle of the firearm, while "front" or "forward" means it is in the direction towards the muzzle of the firearm.

While a current embodiment of a firearm with shell holder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm stock comprising:

a body including a forend having an exterior contour and a bottom;

the bottom of the forend having an elongate slot;

a bipod having a plurality of legs pivotally attached at one end of the legs to the bottom of the forend;

the bipod having an unfolded position in which an opposing end of the legs extends downwards beyond the exterior contour of the forend;

the bipod having a folded position in which the opposing end of the legs is received within the elongate slot with the legs substantially within the exterior contour of the forend;

a first biasing element connected to the forend, and operable to generate a biasing force to pivot the legs laterally away from the stock toward the unfolded position when the legs are in the folded position;

a latch operable to selectably retain the legs in the folded position against the biasing force, such that actuation of the latch enables the biasing element to propel the legs toward the unfolded position; and a second biasing element operable to spread the legs apart.

2. The firearm stock of claim 1 further comprising:

wherein the first biasing element is a button attached to the bottom of the forend that is spring biased to protrude into the slot;

wherein the button is displaced from the slot by the opposing end of the legs when the bipod is in the folded position, which compresses the spring; and wherein the spring decompresses and urges the button downwards, which displaces the opposing end of the legs from the slot.

3. The firearm stock of claim 1 further comprising:

a block attached to the bottom of the forend within the slot;

the block having a central bore that receives an axle having opposing ends;

the end of the legs attached to the bottom of the forend each defining a major bore that receives one of the opposing ends of the axle;

the end of the legs attached to the bottom of the forend each defining opposed minor bores that communicate with the major bore;

each opposing end of the axle defining a bore; and wherein the minor bores of a selected leg are axially registered with a selected axle bore so that a fastener received within the minor bores of a selected leg and the selected axle bore secures the selected leg to a selected end of the axle; and wherein the legs can pivot about both the axle and the fasteners.

4. The firearm stock of claim 3 wherein the minor bores, axle bores, and fasteners are positioned perpendicularly to the axle.

5. The firearm stock of claim 3 further comprising:

the second biasing element comprising a spring having opposed ends;

the end of the legs attached to the bottom of the forend each defining opposed apertures that receive one of the opposed ends of the spring; and wherein the spring biases the legs to pivot outwards about the fasteners.

6. The firearm stock of claim 5 further comprising the elongate slot having a widened portion on either side that receives a portion of the end of the legs pivotally attached at one end to the bottom of the forend when the bipod is in the unfolded position.

7. The firearm stock of claim 6 further comprising:

the opposing end of the legs each forming an angled pad; and wherein the widened portion of the slot is angled such that the angled pads are substantially parallel to the bottom of the forend when the bipod is in the unfolded position.

8. The firearm stock of claim 6 wherein the end of the legs pivotally attached to the bottom of the forend are closely held within the elongate slot, thereby compressing the spring, as the bipod pivots about the axle until the end of the legs pivotally attached to the bottom of the forend reaches the widened portions, at which point the spring decompresses and urges the end of the legs pivotally attached to the bottom of the forend to pivot about the fasteners into the widened portions.

9. The firearm stock of claim 3 wherein the end of the legs attached to the bottom of the forend is received within the central bore of the block when the bipod is in the unfolded position and the end of the legs attached to the bottom of the forend is withdrawn from the central bore of the block when the bipod is in the folded position.

10. The firearm stock of claim 3 further comprising the end of the legs attached to the bottom of the forend each defining a substantially rectangular recess that encompasses the major bore.

11. The firearm stock of claim 1 wherein the end of the legs pivotally attached to the bottom of the forend are pivotally attached within the elongate slot.

12. The firearm stock of claim 1 further comprising:

the legs having a flat forward facing surface; and the flat forward facing surface being substantially flush with the exterior contour of the forend when the bipod is in the folded position.

13. The firearm stock of claim 12 further comprising the bottom of the forend being a flat surface.

14. A firearm stock comprising:

a body including a forend having a bottom;

a block connected to the bottom of the stock;

the block defining a transverse bore, and having opposed side faces;

a pair of bipod legs each having a pivot end and an opposed free end, the legs each being pivotally connected to an axle passing through the transverse bore;

the legs being movable between a stowed position in which the legs are adjacent to the bottom of the forend, and a support position in which the legs are extended away from the bottom;

the axle being connected to each of the legs proximate to the pivot end of each leg, and spaced apart from the pivot end;

a compression spring being received between the legs between the axle and the free end, and operable to bias the free ends of the legs apart;

a first biasing element connected to the forend, and operable to generate a biasing force to pivot the legs laterally away from the stock toward the support position when the legs are in the stowed position;

a latch operable to selectably retain the legs in the stowed position against the biasing force, such that actuation of the latch enables the biasing element to propel the legs toward the support position;

the legs each having a contact surface between the pivot end and the axle, each contact surface facing the block;

wherein when the legs are in the stowed position, the contact surfaces are biased against the block in response to the compression spring bias to limit the free ends from spreading apart; and wherein when the legs are in the support position, the contact surfaces are registered with the transverse bore of the block to enable the pivot ends to enter the bore, and the free ends to spread apart.

15. The firearm stock of claim 14 wherein the forend defines a cavity receiving the legs when in the stowed position.

16. The firearm stock of claim 15 wherein the block is entirely received within the cavity.

17. The firearm stock of claim 15 further comprising:

wherein the biasing element is a button attached to the bottom of the forend that is spring biased to protrude into the cavity;

wherein the button is displaced from the cavity by the free end of the legs when the legs are in the stowed position, which compresses the spring; and wherein the spring decompresses and urges the button downwards, which displaces the free end of the legs from the cavity when the latch mechanism is operated to release the free ends of the legs in the cavity.

18. The firearm stock of claim 15 further comprising:

the free end of the legs each having a notch;

the latch having a cam surface that is spring biased to protrude into the cavity;

wherein the notches receive the cam surface when the legs are in the stowed position; and wherein the cam surface of the latch is withdrawn from the notches in the legs when the legs are in the support position.

19. The firearm stock of claim 14 further comprising:

the free end of the legs each forming an angled pad; and wherein a portion of the cavity is angled such that the angled pads are substantially parallel to the bottom of the forend when the bipod is in the unfolded position.

* * * * *